US007965194B2

(12) United States Patent
Martini

(10) Patent No.: US 7,965,194 B2
(45) Date of Patent: Jun. 21, 2011

(54) OPERATION ABNORMALITY DETECTOR OF ELECTRONIC MODULES, PARTICULARLY A CARD READER IN A SELF-SERVING BANK MACHINE

(75) Inventor: Joao Carlos Oliveira Martini, Osasco (BR)

(73) Assignee: Banco Bradesco S.A., Osasco (BR)

( * ) Notice: Subject to any disclaimer, the term of this patent is extended or adjusted under 35 U.S.C. 154(b) by 273 days.

(21) Appl. No.: 12/301,732

(22) PCT Filed: May 23, 2007

(86) PCT No.: PCT/BR2007/000125

§ 371 (c)(1),
(2), (4) Date: Nov. 20, 2008

(87) PCT Pub. No.: WO2007/134418

PCT Pub. Date: Nov. 29, 2007

(65) Prior Publication Data

US 2009/0231130 A1 Sep. 17, 2009

(30) Foreign Application Priority Data

May 24, 2006 (BR) ..... 0602085

(51) Int. Cl.
*G08B 21/00* (2006.01)

(52) U.S. Cl. ..... 340/657; 340/540; 235/379; 705/43

(58) Field of Classification Search ..... 340/657, 340/540; 237/379, 380, 381, 382; 705/43, 705/39, 42

See application file for complete search history.

(56) References Cited

U.S. PATENT DOCUMENTS 7,118,031 B2 * 10/2006 Ramachandran et al. .... 235/379

FOREIGN PATENT DOCUMENTS

| | | | |
|---|---|---|---|
| EP | 0454570 | A | 10/1991 |
| FR | 2474204 | A | 7/1981 |
| FR | 2554262 | A | 5/1985 |
| JP | 4054585 | A | 2/1992 |
| JP | 8214368 | A | 8/1996 |
| JP | 2004/227443 | A | 8/2004 |

* cited by examiner

*Primary Examiner* — Jeffery Hofsass
(74) *Attorney, Agent, or Firm* — Abelman, Frayne & Schwab

(57) ABSTRACT

An operation abnormality detector of electronic modules detects an abnormality in an associated device, such as the presence of a foreign body nearby the device. The detector can be used, for example, in the mouthpiece of a card reader of a self-serving banking machine. Upon detecting an abnormality, operation of the machine can be suspended by turning off its display, precluding fraud with unauthorized cards or vandalism. Upon detecting the abnormality, an alert is set to an alarm central.

4 Claims, No Drawings

OPERATION ABNORMALITY DETECTOR OF ELECTRONIC MODULES, PARTICULARLY A CARD READER IN A SELF-SERVING BANK MACHINE

CROSS-REFERENCE TO RELATED APPLICATION

This is a U.S. National Phase Application under 35 U.S.C §371 of International Patent Application No. PCT/BR2007/000125, filed May 23, 2007, which claims the benefit of Brazilian Application No. PI0602085-2, filed May 24, 2006, each of which is incorporated by reference in its entirety herein. The International Application designated the United States and was published in English on Nov. 29, 2007 as WO 2007/134418 A1 under PCT Article 21(2).

FIELD OF THE INVENTION

The present invention refers to an operation abnormality detector of electronic modules, particularly to be used in the mouthpiece of self-serving banking card reading machines.

BACKGROUND OF THE INVENTION

The exposition that follows, for simplicity of explanation, illustrates the invention according to a particular embodiment, which is, an operation abnormality detector of electronic modules, utilized in the mouthpieces of card readers banking terminals, without being restricted by this motive to only this embodiment, being possible to be utilized in money, checkbook, banking deposit envelopes retrieval mouthpiece, and in any other place where it will be utilized an electronic module of a self-serving machine.

Banking machines of the self-serving terminals type are known to a person skilled in the art where the user can, without the aid of a banking employee, perform banking transactions such as: draft money, deposit values, get statement of his/her account, make transfers between accounts, etc.

Except for few operations, for example, banking deposit transactions, the remaining ones require the user to utilize a magnetic card and a password to perform them.

In order to utilize a self-serving terminal the user must insert the magnetic card in a notch of a mouthpiece or card reader device that, after reading it requests some data from the user and card in order to allow the realization of the banking transactions.

Upon inserting the card in said mouthpiece, the information comprised in its magnetic tape is read. After the reading completion the user removes the card.

Because the machines are often arranged in a non-guarded locale the occurrence of fraud is common.

A common type of fraud that is known is the changing of the card reader module or the installation of a false mouthpiece over the original that, being of alike appearance to the original, mislead the user that does not realizes it as being a false mouthpiece. The magnetic reader of the false mouthpiece reads and storages the card data, while a camera installed at the terminal cabin registers the images of the user typing his/hers password, or any other data required by the machine. With these data in hand, the defrauder clones the users' cards and start performing w4Qdrawals and transfers from their accounts.

In order to avoid this type of fraud, keyboard protectors have been utilized that make difficult or even preclude the data typed by the user from being captured by any camera.

It occurs that to bypass this measure, defrauders install keyboards superposed to the machine keyboard. So, when typing the password, it is registered by the defrauding keyboard.

In order to avoid this to occur and to preclude the theft of information contained in the user card, the present invention presents an operation abnormality detector of the card reader, which in the occurrence of a substitution of the original or superposing of a false mouthpiece, informs the alarm central and, for example, deactivates the display, not allowing the use of the terminal by any user.

In this way the present detector avoids the reading and registering of data from the card by third parties, precluding accordingly the cloning of the magnetic cards.

SUMMARY OF THE INVENTION

It concerns to an operation abnormality detector of electronic modules to be positioned at the entry of a card reader of a self-serving machine, capable of capturing a change of electromagnetic field around the card reader, comprised of an antenna, a sensor for picking up and transforming the signal received by the antenna; and one control board for interpreting these information that is sent by the sensor, evaluating it and eventually alerting the occurrence of fraud, with the suspension of the machine operation. By means of a set of routines, the detector evaluates the presence of an alien device, alerts an alarm central and stops the operation of the machine display or puts it into maintenance mode.

Therefore, the user seeing that the display is off or in maintenance will know that it is out of service, and will not utilize it, avoiding the information of his/hers card to be copied.

DETAILED DESCRIPTION OF THE INVENTION

The present invention relates to an operation abnormality detector of electronic modules to be installed in the mouthpiece of a card reader of a self-serving banking machine that when detecting the occurrence of a non usual utilization of the reader, signalizes an alarm central and turns the machine display off, so avoiding its utilization.

Said detector comprises an antenna for picking up a change in electromagnetic field around the card reader; a sensor for decoding the signal received by the antenna; and a control board that receives the information decoded by the sensor, evaluates the occurrence and sending an eventual alert of fraud occurrence, for example, with the suspension of the operation of the machine, turning off the image or placing it into maintenance mode.

Said antenna is made of conductive metallic material and its function is picking up a change to the electromagnetic field around the card reader. Any occurrence such as the simple placing of a user's hand, insertion and removal of a banking card, superposing of a mouthpiece, removal of the reader, etc., promotes a change in the electromagnetic field that thus is received by the antenna.

Each type of occurrence promotes a changing magnitude in the electromagnetic field, and from this change normality or abnormality operating parameters are established.

Occurrences like superposing of the reader with a false mouthpiece or its removal are established as abnormal. Therefore, when an abnormality occurs, the machine display is turned off in such a way to preclude the use of the machine by the user.

The sensor decodes the signal received by the antenna, transforms it into digital signals, and from them into information capable of being read by the control board. The control board receives this sensor information, compares it with the normal and abnormal occurrences, signalizing the mouthpiece status. If the information corresponds to an abnormal occurrence, an alert to the alarm central of the bank is sent, and, for example, at the same time the display is turned off or put into maintenance mode.

Upon the detection of an abnormal occurrence the system can activate one or more of the following events: to turn off the machine display, to alert a police or control station, to activate a sound and/or visual alarm, to close the room where the machine is located, to issue an audible message announcing the occurrence, to activate a camera registering the identity of the agent causing the occurrence, etc.

The control board translates the information received from the sensor, compares it with pre-established information as normal or abnormal, and prepares a signal indicating its ok or not ok status, when the information is normal or abnormal, respectively. If abnormal, in a preferential embodiment of the present invention, the board sends a signal of the situation status to an alarm central and turns off the display. Being the information normal the machine continues in operation.

After the removal, for example of the false reader or superposed mouthpiece from the device that is promoting the abnormality in the electromagnetic field of the reader, the terminal is cleared for operating.

Thus, in the event, for example of changing the original reader by a false one or the installation of a mouthpiece over it, there is a change in the electromagnetic field of the card reader that is picked tip by the antenna, decoded and transformed by the sensor, and translated by the control board into a signal that indicates the situation. Upon the replacement of the original reader or the clearing of it from a false mouthpiece, the system identifies a re-establishing of a "normal" signal indicating without abnormality, and the display is turned on again, allowing the utilization of the machine normally.

In this way the detector is activated whenever a foreign body is installed in the card insertion mouthpiece of the self-serving machine, or in other equipment that will utilize the reading of data from the banking card.

Therefore, in case there will be an attempt of changing readers or mouthpiece superposing by defrauders, the device will detect the change in the electromagnetic field, turn off the display and send an abnormality message to an alarm central, not allowing the machine to be used.

Preferentially, the detector does not comprise software specific to this operation, but communicates with software of the self-serving machine that is directed to this purpose.

In a particular way, the antenna is installed inside the mouthpiece of the card reader of the machine and/or any other part where the reading will be necessary, and captures the change in the electromagnetic field around the card reader of the self-serving machine.

The sensor is installed in the mouthpiece of the card reader, performs the electric reading of the signals picked up by the antenna, and informs the control board on the status of the electromagnetic field around the reader. Preferentially, an electronic circuit comprised of a printed circuit board and electronic components is connected to the antenna. The sensor, through the antenna, makes the electric reading of the environment conditions around the card reader of the self-serving machine, transmitting this reading to the control board. The results from these readings may oscillate when there is external and internal interference in the card reader, the level of these oscillations indicates if it is a normal transaction or a vandalism act.

The control board preferentially comprises a printed circuit board and electronic components connected to an alarm central of the self-serving machine. It is preferentially installed inside the self-serving machine's vault, analyzes the readings sent by the sensor, verifies the readings indicate a normal transaction or a vandalism act. If a normal transaction, there is no reaction from the board. If a vandalism act or fraud is indicated, the board stops the operation of the machine, the video display is turned off or placed into maintenance mode and the occurrence is informed to an alarm central of the machine.

A person skilled in the art promptly will note, from the description, several ways for realizing the invention without departing from the scope of the attached claims. The invention is limited only by the scope of the claims and their equivalents.

What is claimed is:

1. A self-serving banking machine comprising:

a card reader;

a display;

control circuitry for controlling the operation of said machine including said card reader and said display; and an abnormality detector system associated with said card reader;

wherein said abnormality detector system comprises:

an antenna adapted to receive signals representing an electromagnetic field around the card reader;

a sensor electronically coupled to said antenna which monitors and decodes the signals received by the antenna, wherein by monitoring said signals said sensor can detect an abnormality in said electromagnetic field as such abnormality occurs; and an electronic control board which is coupled to said sensor for receiving the information decoded by the sensor and for determining whether such information represents a normal electromagnetic field or an abnormal electromagnetic field;

wherein said control board transmits signals to said control circuitry representing an indication of either normal or abnormal card reader conditions;

wherein said control circuitry may allow normal operation of said display only while receiving signals indicating normal conditions; and wherein said control circuitry, in response to receiving a signal indicating a change from normal condition to abnormal condition, either deactivates the display or changes such display to a maintenance mode, thereby preventing users from using said machine.

2. The machine of claim 1, wherein the control board activates one or more of the following additional events in response to determining that an electromagnetic field charge is abnormal: alert to an alarm central, alert to a police or control station, activation of sound and/or visual alarm, closing of the room where the machine is located, output of an audible message communicating the occurrence, or activation of a photographic or shooting equipment registering the identity of the agent causing the occurrence.

3. The machine of claim 2, wherein the control board activates an alert to an alarm central at the same time that it turns off the machine display.

4. A machine of claim 1, wherein said control circuitry, in response to receiving signals indicating a change from abnormal condition to normal condition, reactivates said display to enable users to again use the machine.

* * * * *